US010752561B2

(12) United States Patent
Nesveda

(10) Patent No.: US 10,752,561 B2
(45) Date of Patent: Aug. 25, 2020

(54) FUEL FOR PYROTECHNIC MIXTURES EMITTING IN THE NEAR-INFRARED REGION

(71) Applicant: SELLIER & BELLOT A.S., Vlasim (CZ)

(72) Inventor: Jiri Nesveda, Vlasim (CZ)

(73) Assignee: SELLIER & BELLOT A.S., Vlasim (CZ)

( * ) Notice: Subject to any disclaimer, the term of this patent is extended or adjusted under 35 U.S.C. 154(b) by 223 days.

(21) Appl. No.: 14/366,275

(22) PCT Filed: Dec. 18, 2012

(86) PCT No.: PCT/CZ2012/000134

§ 371 (c)(1),
(2) Date: Jun. 18, 2014

(87) PCT Pub. No.: WO2013/091592

PCT Pub. Date: Jun. 27, 2013

(65) Prior Publication Data

US 2014/0332126 A1 Nov. 13, 2014

(30) Foreign Application Priority Data

Dec. 19, 2011 (CZ) ..... 2011-839

(51) Int. Cl.
*C06B 43/00* (2006.01)
*C06C 15/00* (2006.01)
(Continued)

(52) U.S. Cl.
CPC ..... *C06B 43/00* (2013.01); *C06C 15/00* (2013.01); *F42B 5/15* (2013.01); *F42B 12/382* (2013.01)

(58) Field of Classification Search
CPC ..... C06B 43/00; C06C 15/00; F42B 5/15
See application file for complete search history.

(56) References Cited

U.S. PATENT DOCUMENTS 1,511,771 A 10/1924 Rathsburg
1,708,187 A 4/1929 Sterner
(Continued)

FOREIGN PATENT DOCUMENTS

CA 448625 5/1948
CN 101514210 8/2009
(Continued)

OTHER PUBLICATIONS

International Search Report of International application No. PCT/CZ2012/000134, dated Aug. 22, 2013.
(Continued)

*Primary Examiner* — Aileen B Felton
(74) *Attorney, Agent, or Firm* — Pearl Cohen Zedek Latzer Baratz LLP

(57) ABSTRACT

Inorganic fuel selected from the group of sulphocyanides of noble metals as specially copper, as well as the derivatives of urea and semicarbazide and theirs derivatives and organic fuel selected from the group of thiols with sulphur bound in the —SH group or in the heterocyclic rings and the metal salts of these compounds, mostly cuprous or cupric, which are suitable for the infrared tracer compositions used in bullets. With a suitable oxidant, which is zinc peroxide, the fuel forms binary mixtures that, during combustion, emit radiation in the near-infrared region that is invisible to the naked eye. On the basis of this invention tracer compositions do not require any additional auxiliary pyrotechnic systems. They are intended for use in infrared tracers of conventional calibres of bullet ammunition.

12 Claims, 2 Drawing Sheets

(51) Int. Cl.
*F42B 5/15* (2006.01)
*F42B 12/38* (2006.01)

(56) References Cited

U.S. PATENT DOCUMENTS

| | | | | |
|---|---|---|---|---|
| 1,756,255 | A | 4/1930 | Sterner | |
| 2,323,445 | A | 7/1943 | Bockmuhl et al. | |
| 2,426,586 | A | 9/1947 | Beber | |
| 2,480,141 | A * | 8/1949 | King | C06B 41/02 149/28 |
| 3,667,842 | A | 6/1972 | Wharton | |
| 3,761,583 | A | 9/1973 | Gladstone | |
| 3,773,223 | A | 11/1973 | Guidi et al. | |
| 3,974,170 | A | 8/1976 | Campbell et al. | |
| 4,493,802 | A | 1/1985 | Hagen et al. | |
| 5,587,552 | A | 12/1996 | Dillehay et al. | |
| 5,639,984 | A | 6/1997 | Nielson | |
| 5,750,922 | A * | 5/1998 | Seeger | C06B 29/00 102/288 |
| 5,811,724 | A | 9/1998 | Henry, III et al. | |
| 2004/0025992 | A1 * | 2/2004 | Galluzzi | C06C 7/00 149/47 |
| 2004/0226639 | A1 | 11/2004 | Redecker et al. | |
| 2006/0219339 | A1 | 10/2006 | Guindon et al. | |
| 2011/0239887 | A1 * | 10/2011 | Sandstrom | C06B 33/08 102/204 |

FOREIGN PATENT DOCUMENTS

| | | |
|---|---|---|
| CZ | 299393 | 7/2008 |
| CZ | PV 2010-370 | 11/2011 |
| EP | 0462666 | 12/1991 |
| EP | 2360134 | 8/2011 |
| GB | 323802 | 1/1930 |
| GB | 1362352 | 8/1974 |

OTHER PUBLICATIONS

A.Z. Moghaddam et al "Thermoanalytical Studies on Pyrotechnic Reactions", Scientia Iranica, 2003, vol. 10, No. 3, pp. 267-272.

* cited by examiner

SPECTRAL DISTRIBUTION

PLANCK PREMISE RADIANT ENERGY OF ABSOLUTE BLACK BODY

FUEL FOR PYROTECHNIC MIXTURES EMITTING IN THE NEAR-INFRARED REGION

CROSS-REFERENCE TO RELATED APPLICATIONS

This application is a National Phase Application of PCT International Application No. PCT/CZ2012/000134, International Filing Date Dec. 18, 2012, claiming priority of Czech Republic Patent Application No. PV 2011-839, filed Dec. 19, 2011 which are both hereby incorporated by reference.

FIELD OF THE INVENTION

The technical solution relates to the special fuel and its preparation that, with suitable oxidising agents, produces pyrotechnic mixtures emitting radiant energy during its combustion in the near-infrared region and that is designed for bullet ammunition with an infrared tracer mixture.

BACKGROUND ART

The basis for understanding the principle of body emissivity is the concept of the "Absolutely Black Body" that was defined by Kirchhoff in 1860. This is an ideal surface that neither reflects nor transmits light, but does absorb all incidental radiation, regardless of its direction and wavelength. However, an absolutely black body also emits this radiation from its surface ideally. The most accurate comparison is that of a cavity with an inner surface at a constant temperature, which communicates with the outside environment by means of an infinitely small hole, through which enters light, that is completely absorbed regardless of the internal surface of the cavity. In order to define the radiating capacity of the surface of the real body in comparison to the absolutely black body radiation, Kirchhoff defined the emissivity, ε, of the surface of the real body as the ratio between the thermal radiation at a given temperature, T, and the radiation of the absolutely black body at the same T under the same spectral and directional conditions. Absolutely black body emissivity=1.

In 1879 Stefan defined the relation that states that the radiation emitted by a body surface is proportional to the fourth power of the absolute T of the surface. This theory was later developed by Boltzmann, and in this manner a fundamental radiation law was defined, that states that $E=C\times T^4$, i.e. that the energy of radiation E of an absolutely black body at absolute T (° K) is equal to the product of the absolute T to the fourth power and C that represents the Stefan-Boltzmann constant. Based on this relation it is possible to divide all real bodies into two basic groups. The first group are "grey" bodies with an emissivity unrelated to the wavelength and equal to 0.8 and higher. This group includes all thermally non-conductive substances such as most colourless minerals, metallic oxides, ceramics, building materials and additionally most organic compounds and carbon. The second group includes all the coloured and highly thermally conductive materials, especially metals, the emissivity of which is lower in the same proportion as their surface is smoother. The emissivity of these compounds varies significantly in accordance with their wavelength (FIG. 1).

In 1896 Wien derived a formula for calculating the spectral characteristics of blackbody radiation as a function of T and the wavelength, which was adjusted by Planck in the year 1900 to constitute Planck's distribution law, which states that the intensity of radiation continuously changes in accordance with changes in the wavelength. By increasing T the total amount of energy radiated is increased and the peaks of the curves move into the range of shorter wavelengths, i.e. into the region of visible radiation (FIG. 2). The dashed line in FIG. 2 demarcates the values of maximum radiation for each T at a given wavelength. This brings us to the third basic law—Wien's displacement law, which can be expressed mathematically by the following equation: $\lambda=2898/T$, in which λ represents the wavelength. In this manner it is possible to calculate the wavelength in microns, which defines the maximum amount of energy radiated at a given T.

The three fundamental laws described above: the Stefan-Boltzmann law, Planck's distribution law and Wien's displacement law have been of significant help in many fields, including pyrotechnics for over a hundred years. In order to achieve the highest visibility of a flame in various lighting, signalling and tracer mixtures it is necessary to maximise the T of the flame, which is directly proportional to the heat of the reaction of the mixture minus the latent melting and boiling heat of the products and indirect proportional to the specific heat of the products. Therefore, we chose high-calorific fuel mixed with oxidising agents that have a high content of "active" oxygen that produce combustible products, the particles of which have the highest possible melting point and emissivity, approaching the maximum emissivity of an absolutely black body. Therefore, high-calorific metals have a unique function in these mixtures; Mg, for example, while it is in a gaseous state, is burned both on the account of the oxygen from the oxidising agent and atmospheric oxygen too, which maximally increases the volume and the surface area of the flame and produces a high fusible MgO, which has a high emissivity in the range of 500 nm—i.e. optimal for viewing with the human eye. These mixtures work within a temperature range of 1200-3500° C.

In roughly the early 1970's, in connection with continuing improvement to optical instruments for use not only in the area of visible radiation (400-760 nm) but also primarily in the area of long waves, invisible to the human eye, in the near-infrared radiation range (780-1400 nm), the special task became necessary of equipping units conducting night combat operations with devices for night vision, i.e. the development of a special tracer mixture together with the maximum suppression of the emission of visible radiation, operating in the near-infrared radiation range.

FIG. 2 shows which direction it is necessary to take in order to successfully solve this problem. It is based on a maximum reduction of the burning T while maintaining a sufficient quantity of suitable emitters in the combustion products, the emissivity of which most closely approximates that of an absolutely black body. In FIG. 2 it can be seen that this is an extremely difficult task; one that is just within the bounds of possibility for the pyrotechnics art. The reduction of the burning T and thereby also the heat of the reaction of the pyrotechnic mixtures has its limits, because the heat of the reaction in relation to the ignition T is one of the basic criterions for evaluation of a reliability and stability of burning, which is especially significant during burning in small cross sections—in cavities in devices made of highly conductive materials such as bullet jackets and, of course, at a very low ambient T. Too low a value of the "propagation index"—P.I.—i.e. the ratio of the heat of the reaction in cal/g and the combustion temperature in ° C. can then be the cause of the unsatisfactory operation or of the complete malfunctioning of the mixture in the bullet. A combustion T of around 500° C. is considered as a limit in pyrotechnics and mastering reliable combustion for such low temperatures, and especially under the above conditions, is possible only by reducing the ignition T by using highly reactive oxidising agents or fuel, which, however, undesirably increases sensitivity to mechanical impacts and thereby also handling hazards. Even when making every effort in order that these negative effects should be suppressed, the solution will always be borderline, as is demonstrated by the curve corresponding to T 800° K. (approximately 500° C.) in FIG. 2—burning will still to intervene in the visible spectrum region and the intensity of radiation in the infrared region will be limited by the sensitivity of night vision devices, the operating range of which lies between 400 and 1000-1500 nm.

In principle there is also the possibility of a different solution, based on the total absence of solid emitters in the flame. If the flame contains only gaseous components or vapours, the emissivity of which is negligible, this could have a significantly higher T without being visible to the naked eye. Such a flame occurs, for example, during the combustion of ethanol, which, with atmospheric oxygen, burns at T 1600° C. with the production of only gaseous products. For comparison, a candle flame at T 800-1000° C. containing nanoparticles of unburned carbon radiates at a much greater intensity and it was for this reason that it was determined as the basic unit of light intensity in the SI-1 cd/candela. In terms of pyrotechnics, however, the production of non-luminous flames is difficult to achieve.

Manufacturers of ammunition have already been trying to resolve this problem for 40 years. There are basically two types of mixtures emitting in the near-infrared region: mixtures designed for screening equipment against the IR guiding warheads of the enemy's weaponry and the tracers loaded into bullets of various calibres. In the case of the first category it is not so important whether these mixtures will also emit radiation in the visible region, and their composition is different—they also can contain powdered metals. The mixtures for tracers are obviously designed in accordance with the above principles and patterns and are based solely on the usage of non-metallic fuel.

The selection of oxidising agents, which are in principle inorganic oxides, peroxides or salts of inorganic oxyacids, is governed solely by their content of "active oxygen" and their reactivity—i.e. their capacity to split of oxygen in the presence of reducing agents at the lowest T as possible. The best oxidising agents for these purposes appear to be those with both a low content of active oxygen and high reactivity. These are already-known compounds and their selection is very limited. Of the group of metal oxides and peroxides only the metal peroxides and of the peroxides solely those of Ba, Sr and Zn satisfy these requirements. Peroxides, unlike oxides, contain the —O—O— bond, which is less strong than the bond of the Me═O type, in which Me is the metal. Peroxides of Ba and Sr, combinations of which most commonly occur in a number of patents from the 1970's to the 1990's are chemically unstable compounds, however, reacting with water already at a normal T in accordance with the reaction:

$$BaO_2+2H_2O \rightarrow Ba(OH)_2+H_2O_2$$

In addition, both these peroxides occur in the form of stable octahydrates, so if they are used in their anhydrous form they naturally have a tendency to reabsorb water again. Mixtures based on a combination of these peroxides with organic fuel and binders like the calcium resinate and phenolic resins types are described in U.S. Pat. Nos. 3,667,842, 5,639,984 and 5,811,724.

Unlike the peroxides listed above the peroxide of Zn is chemically completely inert, moisture-proof and, in comparison with the peroxide of Ba, environmentally friendlier. In addition, the oxygen is bound there by weaker covalent bonds; therefore it is more reactive in comparison with the Ba and Sr peroxides, which are ionic compounds. Compositions based on zinc peroxide in mixtures with potassium nitrate and a fuel based on alkali salts of organic acids, such as sodium salicylate together with binders based on cellulose derivatives or fluoroelastomers are described in US Patent No. 2006/0219339 A 1. Unfortunately these mixtures are applicable only to medium-calibre ammunition—i.e. 12.7 and higher. The most likely explanation for this limitation is the incapability of these mixtures to burn steadily in significantly smaller cross sections.

The choice of inorganic salts is also considerably restricted—chlorates and perchlorates are completely unsuitable for these purposes, since a mixture with an organic fuel under high pressure explodes in the gun barrel. Ammonium perchlorate releases extremely corrosive hydrogen chloride and, furthermore, it is considered unstable in accordance with the modern evaluation criteria. Of the nitrates only usable are those that are moisture-proof with a sufficiently low point of decomposition. It is therefore necessary to exclude, as extremely hygroscopic, ammonium nitrate, U.S. Pat. No. 5,587,552, and barium and strontium nitrates with overly elevated dissociation points—above 600° C. That leaves only the nitrates of rubidium and caesium, U.S. Pat. No. 3,773,223, as emitters in the near-infrared region, but these are considered as being potentially carcinogenic, and the above-mentioned potassium nitrate that actually does meet the requirements defined. It is environmentally friendly, moderately reactive, and relatively less hygroscopic. Even our company has developed infrared tracers based on mixtures of this oxidising agent with salts and derivatives of aromatic mono- and dicarboxylic acids. These mixtures, which are similar to the black powder, are based on the principle of a cold fuel that consists of organic compounds with a high content of molecular oxygen, cooled by a possible decarboxylation, which is an endothermic reaction. In the same manner as black powder does, they burn reliably even in small cross sections, and their reactivity is directly proportional to the content of oxygen in the molecule. The emitter in the near-infrared region consists predominantly of solid or liquid potassium carbonate. The burning is invisible to the naked eye but sufficiently visible when utilising night vision devices. The problem with this is the unpredictable behaviour of some of these mixtures, especially those containing fuel with a high content of oxygen under high pressures generated in gun barrels. Explosive burning probably takes place, in addition to tracer burn-out, already in the barrel or near the muzzle, which is mistakenly interpreted as a misfire. Though the use of fuel with a lower content of bound oxygen and therefore less reactivity eliminates this problem, but these fuels require the use of pyrotechnic igniters. However, the development of a non-peroxide type of igniter that would operate at sufficiently low temperatures to be invisible to the naked eye failed. Our company tried to solve this problem by using gasless time-delay compositions, the linear burning rate of which independent on the pressure in the weapon and that would be able to delay the ignition of the main composition to a distance sufficiently remote from the muzzle. Dozens of thermitic mixtures, based on the reaction between metal oxides and inorganic non-metallic or metallic fuels were tested. The preparation of a composition that would work reliably at a sufficiently low T and that would thereby be invisible to the naked eye was unsuccessful, however. The excessive ignition T of these mixtures, in principle caused by the lower reactivity of the oxides (500-600° C.), simply makes it impossible to use sufficiently "cold" compositions—see the propagation index—P.I. Other salts of inorganic oxyacids, such as chromates and permanganates, are also unusable for this purpose; the chromates have too high a decomposition T-800° C. or above and, in addition, all the salts of hexavalent chromium are classified as toxic and opposite to this highly reactive permanganates are very unstable.

From the above discussion it is clear that the options available for the use of the known oxidising agents have been practically exhausted and it is unlikely that in the foreseeable future there will be a breakthrough in the field of inorganic oxidising agents and for this reason it is necessary to focus on the search for and development of a special fuel.

DISCLOSURE OF THE INVENTION

The essential feature of the invention lies in the research and development of special inorganic and organic fuels that are compatible with any of the prospective oxidising agents referred to above, thereby creating a pyrotechnic mixture that meets the basic requirements for special infrared tracers and tracers in general, i.e.:

1. Maximum reduction of emission of radiation in the visible spectrum and the assurance of visibility in the near-infrared region when using night vision devices.
2. High mechanical strength and cohesion of the mould due to the extreme mechanical stress occurring during firing.
3. The capability of burning reliably even in the smallest cross-section, i.e. in the cavities of the smallest calibre bullets.
4. Reliable ignitability with the use of pyrotechnic igniters or simply from powder gasses.
5. Minimum dependence of the burning rate on pressure—thereby maximum reduction of gaseous combustion products.
6. Associated with the above, the highest production of the solid waste products that remain subsequent to burning in the cavity of the bullet, thereby ensuring the maximum stability of the centre of gravity during the flight of the bullet—especially in the case of larger calibre bullets.
7. The combustion products of the mixtures utilised should be in greater compliance with the current environmental requirements, especially in terms of their content of toxic heavy metals.

For the development of these fuels was an oxidant of the Zn peroxide type has been selected. That is commercially available in the form of a mixture containing 40 to 50% ZnO, with a content of active oxygen of around 12% that is favourable for achieving the lowest T and the highest content of solids in the combustion products.

The Development was Divided into 3 Stages:

In the first stage all the available types of non-metallic pyrotechnic fuels were tested. The oxygen balance of all the selected mixtures was calculated and these were then successively tested. As potential fuels were tested natural and synthetic resins and polymers, carbohydrates and the already mentioned organic acids, together with their salts and derivatives, containing variable quantities of oxygen in the molecule, also fuels with a high nitrogen content, including metaldehyde, urotropine and dicyandiamide; guanidine derivatives, such as nitroguanidine, guanidine nitrate, nitroaminoguanidine, amino-, diamino- and triaminoguanidine, triaminoguanidine nitrate, aminotetrazole; organometallic compounds such as ferrocene, certain proven non-metallic elements such as sulphur and its compounds and in addition phosphorus and some inorganic compounds such as ferrocyanides and alkali metal hexacyanoferrates (II) and (III). Samples were prepared in gram quantities by a thorough blending of both components in an agate or a porcelain dish, followed by moistening with a suitable organic solvent, drying and granulation. Testing was carried out by ignition by flame of the materials in a loose powder, in a pressed state and in the pressed form in a bullet with a minimal cross-section cavity—of a 5.56 mm calibre, which can be considered as the most stringent test carried out during the testing under static conditions.

The results of this research were remarkable. With a peroxide content above 90%, which was necessary in most cases to achieve a zero or a slightly negative oxygen balance, all the mixtures showed a similar behaviour regardless of the specific type of fuel. They burned only in the flame of the heat source and after the removal of the source the flame again extinguished, which may have been due to the small size of the mould. Only after the reduction of the content of peroxide to below 80-85%, specific characteristics of individual fuels manifested almost independent of the oxygen balance. Although stable combustion was frequently achieved in a loose state and exceptionally also in a well pressed state, none of these fuels induced stable combustion in the cavity of the bullet. In mixtures using fuels based on organic acids, their salts and derivatives, a stable process was achieved by adding several percentages of amorphous boron; the combustion, however, became visible, since this fuel is overly calorific. In some cases, particularly in combinations including carbohydrates, ferrocene, sulphur or phosphorus, explosion occurred during the pressing, whereby the explosiveness of these mixtures was directly proportional to the content of fuel, regardless of the oxygen balance.

In the second stage however, based on the knowledge gained during the first stage, specially selected commercially available fuels were tested. Attention was focused on compounds containing the element that substantially increased the reactivity of solid fuels, i.e. the molecularly bound sulphur. Sulphur is recognised in pyrotechnics as a "trigger" for exothermic reactions and its addition causes both a substantial reduction in the ignition T and in the combustion stabilisation of burning for example black powder. The best-known inorganic compounds containing sulphur are thiocyanates—sulphocyanates of metals. Some of these, primarily potassium salt, produce mixtures with reactive oxidising agents like the potassium chlorate type that are extremely sensitive to friction; due to their hygroscopicity, however, these salts have no practical uses. Thiocyanates of heavy metals such as Pb were utilised historically in primer compositions, based with mercury fulminates, as a fuel. Attention was focused on the insoluble thiocyanates of non-toxic noble metals, such as silver and copper, the salts of which are the most suitable for utilisation for the purpose in question. Copper occurs in compounds as both univalent and divalent, thereby creating two types of thiocyanates. Cupric thiocyanate is a black coloured, amorphous product, insoluble in water and in known solvents, it can be prepared by the simple precipitation of any soluble copper salt using alkaline thiocyanate. When only a non-oxidising acid salt is used and there is a considerable excess of the precipitant or/and some of the reducing agents, such as sulphurous acid is present a white even less soluble cuprous thiocyanate is precipitated. Unlike cupric salt, this product is commercial available. It is off-white in colour, very fine, a highly stable and moisture-proof product with a grain below 5 microns, which thermally dissociates at T 1084° C. Both these individual products and mixtures thereof were also tested in combination with zinc peroxide.

These mixtures are extremely easy ignitable using a match flame and ignited in a volume of only a few grams they only glow; forming a large volume of solid products. During the ignition of the pressed mixture a special effect occurs; the roller of mixture dintegrates and the production of a very large volume of incandescence ash. These mixtures burn reliably in the cavity of the bullet and after finishing of the burning the combustion products fill the entire cavity of the bullet. Copper thiocyanates turned out to be the optimal fuel for this purpose. The carbon provides the combustion, the sulphur initiates and stabilises the reaction and the copper, which is a recognised catalyst for many chemical reactions and also a combustion catalyst, binds a substantial quantity of the sulphur oxides. The amount of the solids, determined by weight was in the range of 80 to 85%, corresponding to cca. 60% of ZnO and 25% of CuS in the combustion products.

Based on these results, a search was initiated for similar organic compounds that contain sulphur, bonded in the —SH group, e.g. mercapto compounds and perhaps also sulphur bound in a heterocycle. From the large quantity of compounds commercially available, several representative compounds, each of which constitutes a typical representative of each group were selected.

One example of a compound containing both functional groups is 2-mercaptothiazoline, summary formula $C_3H_5NS_2$, melting point 101-106° C. This compound is insoluble in water, is soluble in common solvents. It contains cca. 54% of S. Mixture with 80% of zinc peroxide, burns steadily, also in the pressed state, forming a short invisible flame and producing a large amount of solid products. In comparison with the thiocyanates it burns less reliably in the 5.56 bullet.

An example of a compound that contains both functional groups, and additionally also has an aromatic cycle is 2-mercaptobenzothiazole, summary formula $C_7H_5NS_2$, melting point 180-184° C. This compound is almost insoluble in water but is soluble in common organic solvents. It contains about 38% of S. Its elevated content of carbon generates a larger flame during burning and in a mixture with 85% of zinc peroxide it also burns reliably in a pressed state. It does not burn in a 5.56 bullet, however.

An example of a compound with the mercapto group on a tetrazole cycle is 1-methyl-5-mercaptotetrazole, summary formula $C_2H_4N_4S$, melting point 125-128° C., containing cca. 27% of S. This compound is soluble in water and in common solvents. It burns reliably in a mixture with 80% of zinc peroxide, including in a pressed state. It was possible to ignite this mixture in the 5.56 bullet.

An example of a similar compound, which additionally also includes the aromatic cycle, is 1-phenyl-5 mercaptotetrazole, summary formula $C_7H_6N_4S$ with 18% of S, and a melting point of 145-146° C. This compound is insoluble in water but is soluble in common solvents. In a mixture with 80% zinc peroxide it burns reliably with a short flame, also in a pressed state. In the 5.56 bullet this compound burns similarly to compounds containing thiocyanates.

An example of a compound with the mercapto group coupled to the aromatic cycle, together with the carboxylic group is thiosalicylic acid (2-mercaptobenzoic acid) $C_7H_6O_2S$ with 20% of S, melting point 165-166° C. This compound is soluble in common organic solvents. In a mixture with 80% of zinc peroxide it also burns in a pressed state; however an attempt to ignite it in a 5.56 bullet failed. A similar compound is 2,2-dithiodibenzoic acid, summary formula $C_{14}H_{10}O_4S_2$, with the same content of S, melting point 284-286° C., which is insoluble in water and poorly soluble in common organic solvents. It behaves in a similar manner when mixed with zinc peroxide.

Also tested as part of this research were types of fuel based on derivatives of urea, semicarbazide, and also their derivatives. A mixture of thiourea, summary formula $CH_4N_3S$, melting point 181° C., with 80% of zinc peroxide is very easily ignitable and also burns steadily in a pressed state with the production of a large volume of foamy ash. These extremely cold mixtures burn without a flame and the combustion is basically invisible to the naked eye. In the small-calibre bullet, however, these compounds are extinguished—due to their heat dissipation they lack sufficient thermal energy to maintain stable combustion.

Based on the results achieved it is possible to conclude that, as expected, the most reactive fuels proved to be thio derivatives of tetrazoles, while in the case of the other organic compounds reactivity increased proportionately with the increase in the content of S.

In the third stage, special types of fuel that are not described in the literature were laboratory-prepared. Attention was focussed on the possibility of the preparation of metallic salts of the mercapto compounds mentioned above with the aim of further increasing their reactivity. Copper was again chosen as a suitable metal. In the course of the practical experimentation it was discovered that all the copper salts of the above compounds are insoluble, both in water and in common organic solvents, and they can therefore be precipitated from solutions with an almost quantitative yield. Since these compounds are mostly insoluble in water, precipitation must be carried out using solutions of suitable polar solvents, such as alcohol or acetone. As a precipitant it is possible to use one of the copper salts that are soluble in organic solvents, such as cupric chloride or acetate.

Considering that the salts mentioned above are not described in the literature, these salts were tested using the differential thermal analysis method—DTA. The distinguishing characteristics of the individual salts, including their behaviour in mixtures with zinc peroxide:

Cu salt of 2-mercaptothiazoline is a green tinged amorphous or microcrystalline product, insoluble in water and in common organic solvents. During the DTA test it manifested significant endotherm at T 130° C. In a mixture with 85% zinc peroxide it explodes when pressed.

Cu salt of 2-mercaptobenzothiazole is a yellowish-green tinged amorphous or microcrystalline product, insoluble in water and in common organic solvents. During the DTA test it manifests two endotherms at T 230 and 330° C. The mixture with 80% of zinc peroxide can be ignited in a pressed state in a bullet; the combustion ceases, however.

Cu salt of 1-phenyl-5-mercaptotetrazole is a grey-tinged amorphous product, insoluble in water and in common organic solvents. The salt burns well and very rapidly and during the DTA test manifests a significant exotherm at T 230° C. When mixed with 75% of zinc peroxide in a pressed state in the bullet it burns similarly to compounds containing thiocyanates.

Cu salt of 1-methyl-5-mercaptotetrazol has explosive properties with a flash point of 240° C. and was therefore not tested further.

Cu salts of thiosalycilic (2-mercaptobenzoic) acid or of 2,2-dithiodibenzoic acid are a black and green to green-tinged amorphous product, insoluble in water and in common organic solvents. In the course of DTA testing they do not manifest any measurable peaks and decomposition takes place continuously up to T 550° C. The latter salt shows slight endotherm at T above 150° C. Both salts mixed with 80% of zinc peroxide in a pressed state in the bullet burn without the development of flame and for much longer than similar compounds with thiocyanates.

Cu (I) 2-mercaptobenzothiazole is an orange tinged amorphous product, insoluble in water and in common organic solvents. During the DTA test it manifested a significant endotherm at 390° C. When mixed with zinc peroxide no increase in reactivity was observed compared with the copper salt, which shows that an increase in the copper content without a commensurate increase in the sulphur content is ineffective in the case of this compound. The specified ratio in the compound between sulphur and copper must be complied with.

The introduction of metal to the molecules of these compounds was clearly manifested by their increased reactivity, in relation with the metal content in the molecule. While in the case of the heavier molecules with one substitutable hydrogen in the —SH group, the reactivity did not increase substantially; in the case of the smaller molecules with one, or the larger molecules with two hydrogens, such as thiosalicylic acids, containing both the —SH and —OH groups or in the case of dithiodibenzoic acid with two —OH groups the reactivity increased more. This regularity does not apply in the case of inorganic compounds—cupric thiocyanate is more reactive than cuprous thiocyanate.

In case of tetrazole derivatives no substantial increase in reactivity took place, since these derivatives already showed, as anticipated, sufficient reactivity in the form of free acids.

EXAMPLES

Examples of the Laboratory Preparation of New Salts

1. Cu (II) salt of 2-mercaptothiazoline:

Prepare a saturated alcohol solution of 10 g of 2-mercaptothiazoline and of 7 g of copper chloride dihydrate. While stirring vigorously decant the two solutions. Leave the green precipitate to settle (preferably overnight), then filter, wash with alcohol and dry.

2. Cu (II) salt of 2-mercaptobenzthiazole:

Prepare a saturated alcohol solution of 10 g of 2-mercaptobenzthiazole and of 5 g of copper chloride dihydrate. While stirring vigorously decant the two solutions, allow them to settle, then filter, wash with alcohol and dry.

3. Cu (II) salt of 1-phenyl-5-mercaptotetrazole:

Prepare saturated alcohol solutions of 10 g of 1-phenyl-5-mercaptotetrazole and of 5 g of copper chloride dihydrate. While stirring vigorously decant the two solutions, allow them to settle, then filter, wash with alcohol and dry.

4. Cu (II) salt of thiosalicylic acid:

Prepare a saturated alcohol solution of 10 g of thiosalicylic acid and of 13 g of copper acetate monohydrate. Carry out the precipitation, preferably at boiling temperature to achieve a more easily filterable precipitate. Allow it to settle, then filter, wash with alcohol and dry.

5. Cu (II) salt of 2,2-dithiodibenzoic acid:

Prepare an aqueous suspension of 10 g of 2,2-dithiodibenzoic acid and neutralise, it while stirring, using the 0.1-1 N KOH solution. After the black brown product has settled filter it and precipitate the filtrate using a saturated aqueous solution of 5.5 g of chloride dihydrate or of 6.5 g of copper acetate monohydrate. Allow it to settle, then filter, wash with alcohol and dry.

6. Cu (I) salt of 2-mercaptobenzthiazole:

Prepare a saturated alcohol solution of 10 g of 2-mercaptobenzthiazole and an ammoniacal solution of 6 g of cuprous chloride. After precipitation allow it to settle for at least 24 hours, then filter, wash with alcohol and dry.

Examples of the Implementation of Infrared Mixtures

Example 1

The preparation of infrared tracer compositions, consisting of a binary composition of an oxidising agent and fuel, is carried out as follows. 70 parts by weight of zinc peroxide and 30 parts by weight of cuprous thiocyanate are added to the ball mill of an ordinary design, filled with steel, preferably 10 g balls coated with Teflon, and this is then blended and compacted for 3 to 4 hours at a rotation speed of 150-200 rpm. Following this the product is separated from the grinding balls through a sieve and transferred to the flat pan, where it is moistened with a sufficient quantity of an organic solvent, e.g. acetone or hexane, to create a homogeneous paste, which during its spreading out almost completely dries out so that the resulting product can then be granulated by using a sieve of the appropriate mesh size. After drying the product is then ready for loading.

Example 2

Infrared tracer composition consisting of 20% 2-mercaptothiazoline by weight and 80% zinc peroxide $ZnO_2$ by weight.

Example 3

Infrared tracer composition consisting of 20% 1-methyl-5-mercaptotetrazole by weight and of 80% zinc peroxide $ZnO_2$ by weight.

Example 4

Infrared tracer composition consisting of 20% 1-phenyl-5-mercaptotetrazole by weight and 80% zinc peroxide $ZnO_2$ by weight.

Example 5

Infrared tracer composition consisting of 25% Cu salt of 1-phenyl-5-mercaptotetrazole by weight and 75% zinc peroxide $ZnO_2$ by weight.

Example 6

Infrared tracer composition consisting of 20% Cu salt of thiosalicylic acid by weight and 80% of zinc peroxide $ZnO_2$ by weight.

This procedure can be used for the preparation of compositions for infrared tracers from all the special fuels referred to above.

The binary compositions produced can be modified using common ingredients, preferably non-flammable organic binders such as fluoroelastomers (Viton A and B) to facilitate the dosing procedure. In order to reduce T it is possible to add a few % of proven flame retardants, such as carbonates with a lower decomposition T, for example magnesium carbonate.

In addition to the static testing under laboratory conditions that were focused principally on the capability of the stable combustion of the bullets, the most successful compositions, primarily those based on thiocyanates, were subjected to dynamic tests by practical firing. These tracers meet all the tactical and technical requirements. The tests involving the smallest calibre projectiles can be considered as being technically the most demanding and stringent, therefore the reliable functioning of the tracer compositions tested can also be assumed to be applicable to the other bullet ammunition.

INDUSTRIAL APPLICATION

Figure 1:
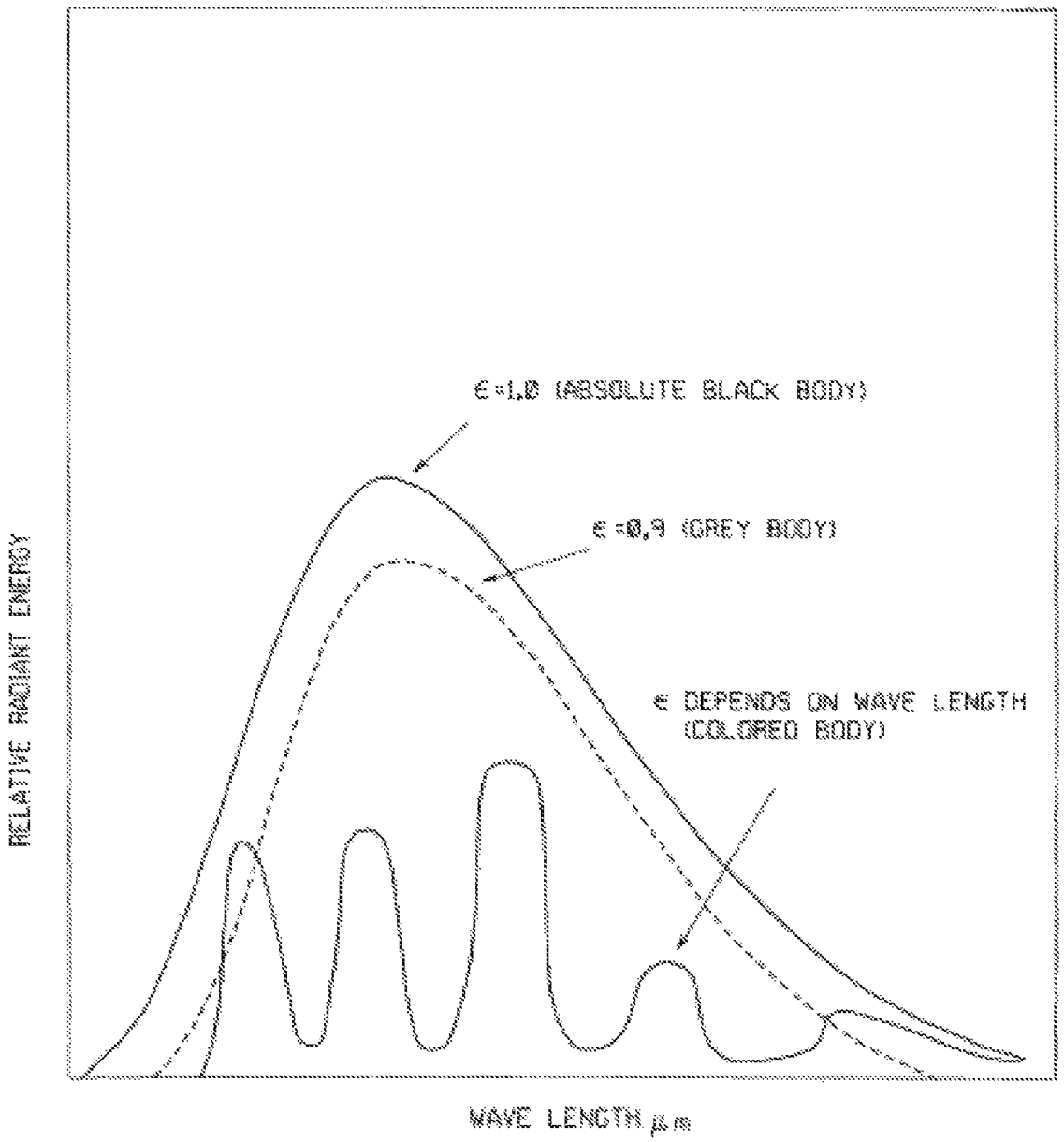
FIG. 1—Spectral distribution
Figure 2:
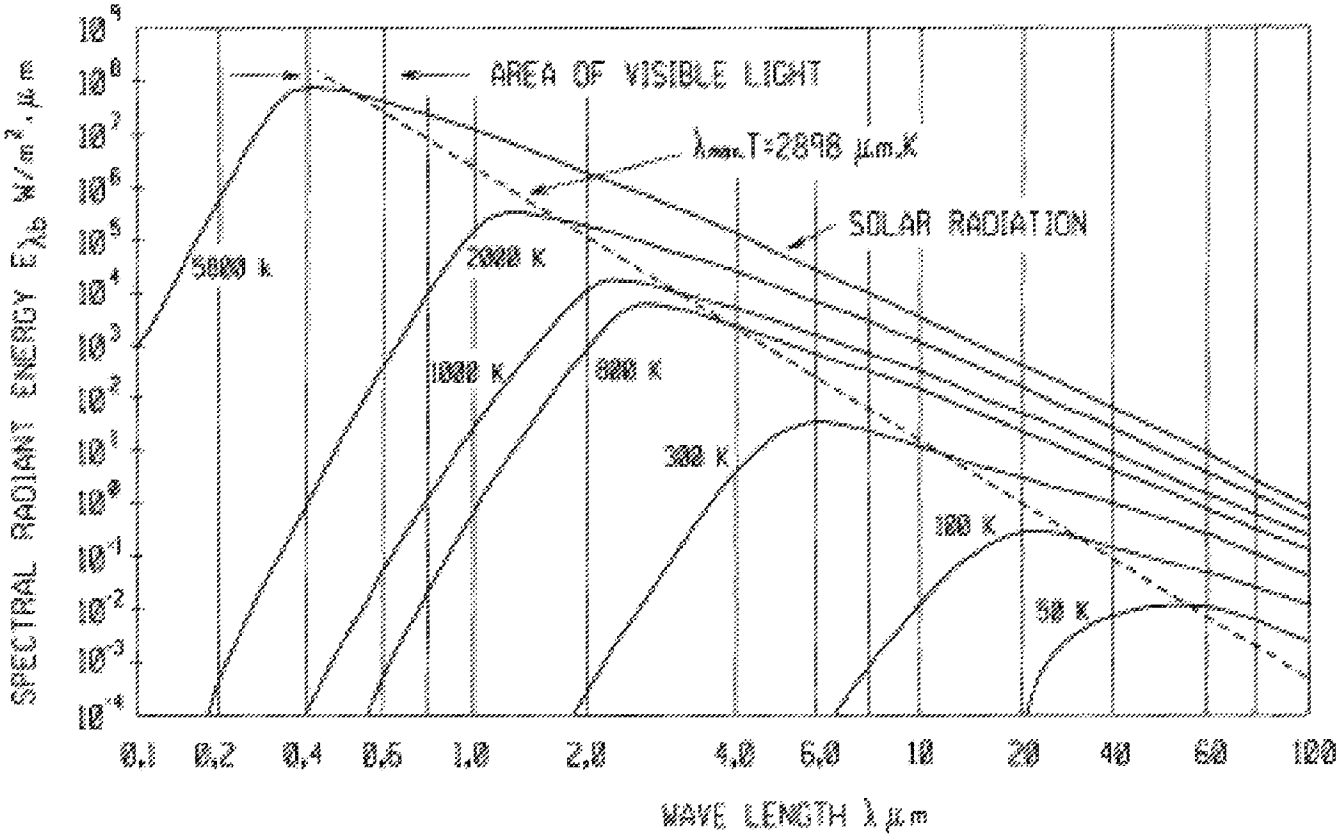
FIG. 2—Planck's assumption concerning the radiation of an absolutely black body

As a special fuel for pyrotechnic mixtures that, together with suitable oxidising agents, produces special mixtures, emitting in the course of its combustion, radiant energy in the near infrared region and that are applicable for the infrared tracer compositions used in common calibres of ball ammunition. Loading of these mixtures into bullets is carried out in a manufacture manner. Infrared mixtures with fuel according to the technical solutions do not require the utilisation of any other special pyrotechnic igniters.

The invention claimed is:

1. A binary pyrotechnic mixture consisting of 70% to 95% by weight of an oxidising agent, which is zinc peroxide ($ZnO_2$), and from 5% to 30% by weight of a fuel comprising:

cuprous salt and/or cupric salt of mercapto compounds with sulphur coupled in the SH-group and/or in a heterocyclic ring, or cuprous salt and/or cupric salt of thiocyanates, wherein the binary pyrotechnic mixture emits radiation in the near-infrared region in a range of 780 nm to 1400 nm.

2. The binary pyrotechnic mixture in accordance with claim 1, wherein the fuel is selected from the group consisting essentially of: Cu(II) salt of 2-mercaptothiazoline; Cu(II) salt of 2-mercaptobenzothiazole; Cu(II) salt of 1-phenyl-5-mercaptotetrazole; Cu(II) salt of thiosalicylic acid; Cu(II) salt of 2,2-dithiodibenzoic acid; and Cu (I) salt of 2-mercaptobenzothiazole.

3. The binary pyrotechnic mixture in accordance with claim 1, said mixture comprising 30% by weight of cuprous thiocyanate and 70% by weight of zinc peroxide ($ZnO_2$).

4. A tracer composition emitting radiation in the near-infrared region, comprising the binary pyrotechnic mixture in accordance with claim 1.

5. The tracer composition in accordance with claim 4, further supplemented with one or more of an additive, organic binder, combustion catalyst or flame retardant.

6. The tracer composition in accordance with claim 5, wherein the flame retardant is magnesium carbonate.

7. The tracer composition in accordance with claim 5, wherein the organic binder is fluoroelastomer.

8. A bullet comprising the tracer composition according to claim 5.

9. A method for preparing the fuel according to claim 1, wherein the fuel is selected from Cu(II) salt of 2-mercaptothiazoline, Cu(II) salt of 2-mercaptobenzothiazole, Cu(II) salt of 1-phenyl-5-mercaptotetrazole, Cu(II) salt of thiosalicylic acid, or Cu (I) salt of 2-mercaptobenzothiazole, the method comprising dissolving a mercapto compound in an organic solvent and precipitating with copper salt, thereby producing Cu(II) salt of 2-mercaptothiazoline, Cu(II) salt of 2-mercaptobenzothiazole, Cu(II) salt of 1-phenyl-5-mercaptotetrazole, Cu(II) salt of thiosalicylic acid, or Cu (I) salt of 2-mercaptobenzothiazole.

10. The method of claim 9 wherein the copper salt is a dihydrate of cupric chloride ($CuCl_2.2H_2O$) or an ammoniacal solution of cuprous chloride ($Cu(NH_3)_3Cl$).

11. A method of for preparing a cupric salt of 2,2-dithiodibenzoic acid, the method comprising suspending 2,2-dithiodibenzoic acid in water, neutralising with 0.1-1.0 N KOH solution, filtering off impurities and subsequently precipitating with a copper salt, thereby producing the cupric salt of 2,2-dithiodibenzoic acid.

12. The method of claim 11 wherein the copper salt is dihydrate of cupric chloride ($CuCl_2.2H_2O$).

* * * * *